US007010919B2

(12) United States Patent
Gourbier

(10) Patent No.: US 7,010,919 B2
(45) Date of Patent: Mar. 14, 2006

(54) METHOD AND INSTALLATION FOR STEAM PRODUCTION AND AIR DISTILLATION

(75) Inventor: Jean-Pierre Gourbier, Le Plessis Trévise (FR)

(73) Assignee: L'Air Liquide, Societe Anonyme A Directoire et Conseil De Surveillance Pour L'Etude et L'Exploitation Des Procedes Georges Claude, Paris (FR)

( * ) Notice: Subject to any disclaimer, the term of this patent is extended or adjusted under 35 U.S.C. 154(b) by 0 days.

(21) Appl. No.: 10/483,917

(22) PCT Filed: Jun. 27, 2002

(86) PCT No.: PCT/FR02/02225

§ 371 (c)(1),
(2), (4) Date: Jun. 8, 2004

(87) PCT Pub. No.: WO03/006902

PCT Pub. Date: Jan. 23, 2003

(65) Prior Publication Data

US 2004/0211183 A1 Oct. 28, 2004

(30) Foreign Application Priority Data

Jul. 12, 2001 (FR) ..... 01 09307

(51) Int. Cl.
*F01K 13/00* (2006.01)

(52) U.S. Cl. ..... 60/645; 60/670

(58) Field of Classification Search ..... 60/645, 60/670

See application file for complete search history.

(56) References Cited

U.S. PATENT DOCUMENTS 4,223,529 A * 9/1980 Willyoung ..... 60/39.181
4,326,382 A * 4/1982 Baardson ..... 60/655
6,117,916 A * 9/2000 Allam et al. ..... 518/702

FOREIGN PATENT DOCUMENTS

EP 0 930 268 A2 1/1999
EP 0 930 268 A3 1/1999

* cited by examiner

*Primary Examiner*—Hoang Nguyen
(74) *Attorney, Agent, or Firm*—Linda K. Russell; Elwood Haynes

(57) ABSTRACT

The invention concerns a method for driving at least a compression machine (7, 8) of an air distillation unit (3) which supplies oxygen and/or nitrogen and/or argon to an industrial plant (1) producing water vapour. In normal running conditions, the compression machine is driven at least partly by a steam turbine (13) fed with said water vapour, which is input at an input port (15) of the turbine. The turbine has two input ports (15, 16) which correspond to different intake pressures. During at least one operating phase of said plant (1), the turbine is partly supplied with water vapour from an auxiliary water vapour source (21) and input at the turbine other input port (16). The invention is useful for supplying air gas to a synthetic hydrocarbon production plant.

18 Claims, 1 Drawing Sheet

-1-
HP GN
HP GOX
GN
-10-
-11-
LOX
AIR HP
AIR MP
AIR
-13-
-21-

METHOD AND INSTALLATION FOR STEAM PRODUCTION AND AIR DISTILLATION

BACKGROUND OF THE INVENTION

1. Field of the Invention

The present invention relates to a method of driving at least one compressor of an air distillation unit which delivers oxygen and/or nitrogen and/or argon to an industrial unit producing steam, this method being of the type in which, in the steady state, the compressor is at least partly driven by steam expansion means with production of external work, said means being supplied with steam coming from said industrial unit, this steam being introduced into an inlet of said expansion means.

2. Related Art

Certain industrial processes that consume oxygen and/or nitrogen and/or argon, such as synthetic hydrocarbon processes (referred to as gas-to-liquid or GTL processes), are exothermic and generate steam. When the pressure and/or the temperature of this steam make it unusable on the site, the steam is generally utilized as a drive supply, via a steam turbine, of at least one compressor of the air distillation unit that produces oxygen. The steam turbine may be a back-pressure turbine, exhausting at a pressure above atmospheric pressure, or a condensing turbine, exhausting at a pressure below atmospheric pressure and associated with a water condenser, cooled by water or by the ambient air, and with a pump for recycling the water back into the steam production boiler.

However, the steam is fully available only in the steady state, which poses the problem of starting up the entire plant.

EP-A-0 930 268 discloses an air separation apparatus whose main compressor is coupled to an electric motor and a steam turbine that receives steam at two different pressures. During startup, the main compressor and the electric motor operate using electricity generated by a gas turbine.

SUMMARY OF THE INVENTION

The object of the invention is to solve this problem in a particularly flexible manner, while eliminating the electric motor.

For this purpose, the subject of the invention is a method of driving at least one compressor of an air distillation unit that produces oxygen and/or nitrogen and/or argon, this method being of the type in which, in the steady state, the compressor is driven only by steam expansion means with production of external work, this steam being introduced into an inlet of said expansion means, said steam expansion means having two inlets that correspond to different, respectively high and medium, intake pressures and, during at least the startup of said industrial unit, said expansion means are at least partly supplied with auxiliary steam coming from an auxiliary steam supply and introduced into an inlet of these expansion means.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers.

Examples of how the invention is implemented will now be described in conjunction with the drawings in which.

DESCRIPTION OF PREFERRED EMBODIMENTS

Figures 1, 2A, 2B, 2C, 3A, 3B:
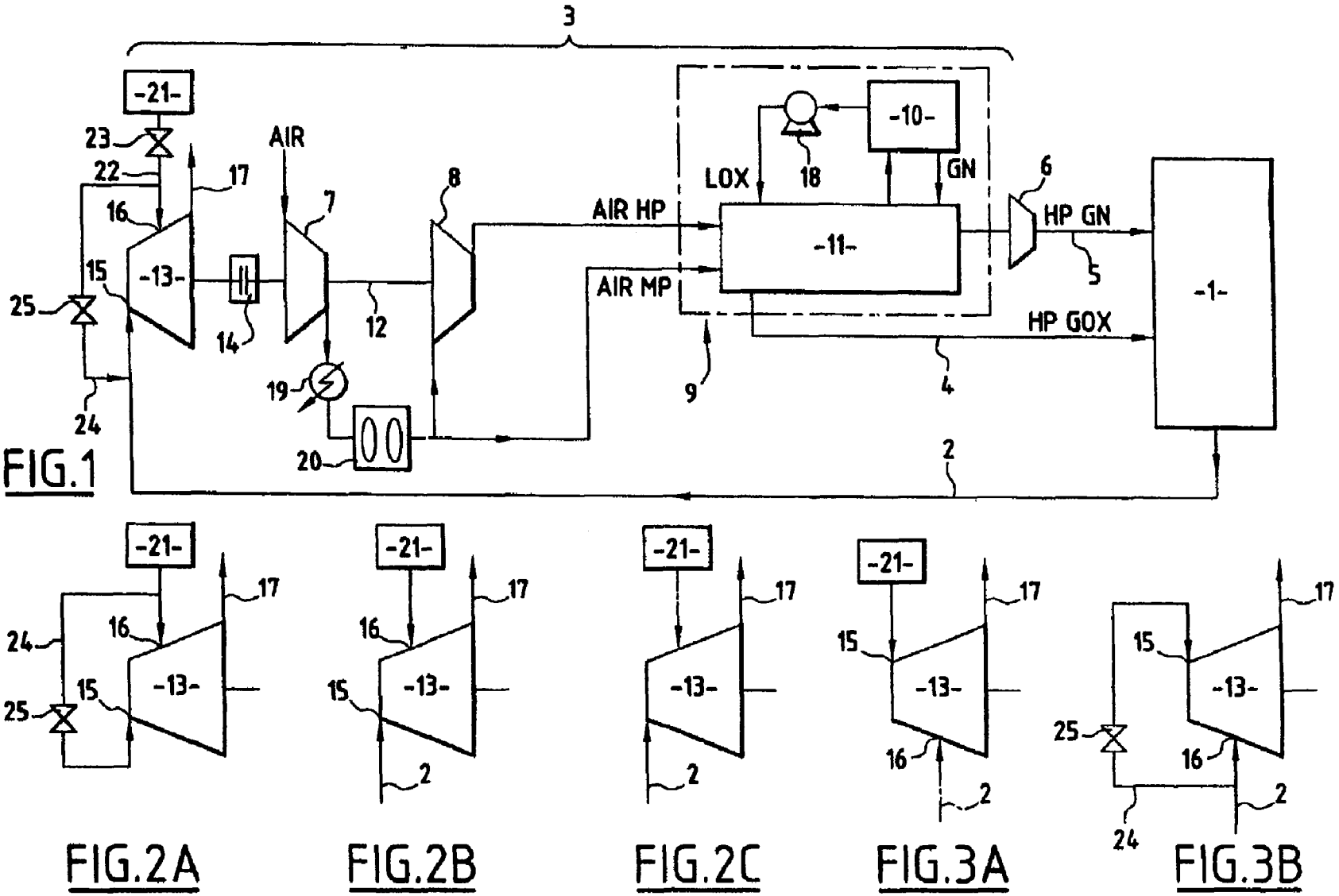
FIG. 1 shows schematically a combined plant according to the invention.
FIGS. 2A to 2C illustrate three successive startup phases of this plant.
FIGS. 3A and 3B similarly illustrate the startup of an alternative plant.

The method according to the invention may have one or more of the following features:

- the auxiliary steam comes from an auxiliary steam supply and is introduced into the other inlet and/or the same inlet of these expansion means;
- said operating phase includes the startup phase of the said industrial unit;
- as the industrial unit is progressively brought up to the normal operating conditions, the industrial unit being supplied with oxygen and/or nitrogen and/or argon by the air distillation unit, the steam produced by the latter is used to deliver some of the energy for driving the compressor via said expansion means;
- in the steady state that turbine means are predominantly supplied with steam coming from said industrial unit;
- the inlet corresponding to the high intake pressure of said expansion means is supplied practically permanently;
- the auxiliary steam is at the medium intake pressure and the following are supplied in succession:
  - the two inlets with the auxiliary steam;
  - the high-pressure inlet with the steam coming from said industrial unit and the medium-pressure inlet with the auxiliary steam; and
  - in the steady state, at least the high-pressure inlet with the steam coming from the industrial unit;
- the auxiliary steam is at the high pressure and the following are supplied in succession:
  - the high-pressure inlet with the auxiliary steam;
  - the high-pressure inlet with the auxiliary steam and the medium-pressure inlet with the steam coming from said industrial unit; and
  - in the steady state, the two inlets with the steam coming from said industrial unit;
- the auxiliary steam is at the high pressure and the following are supplied in succession:
  - the high-pressure inlet with the auxiliary steam; and
  - the high-pressure inlet with the auxiliary steam and the medium-pressure inlet with the steam coming from said industrial unit;
- at least two compressors coupled to a single shaft, namely a main air compressor and another gas compressor, especially an air booster, of the air distillation unit are driven in a similar manner; and
- said expansion means comprise a steam turbine having a body provided with two inlets.

The subject of the invention is also a combined air distillation/steam production plant of the type comprising, on the one hand, at least one air distillation unit, which comprises at least one compressor driven only by steam expansion means with production of external work, and a cold box containing an air distillation apparatus and a heat exchange line that is designed to cool the compressed air down to a temperature allowing it to be distilled, and, on the other hand, an industrial unit which is optionally supplied with oxygen and/or with nitrogen and/or with argon produced by the air distillation unit and which produces steam, at least some of this steam feeding the steam turbine, said expansion means having two inlets that correspond to two different, respectively high and medium, intake pressures, the plant including an auxiliary steam supply, and this supply delivering steam at a pressure that corresponds to one of the two inlets of said expansion means and being designed to be connected to this inlet, whereas the industrial unit produces steam at a pressure that corresponds to the other inlet of said expansion means and is designed to be introduced into this other inlet.

The combined plant shown in FIG. 1 consists, on the one hand, of a GTL unit 1 that produces, among other things, high-pressure steam in a line 2, and on the other hand, an air distillation unit 3 that supplies the unit 1 with high-pressure gaseous oxygen HPGOX via a line 4 and also with high-pressure gaseous nitrogen HPGN via a line 5 equipped with a nitrogen compressor 6. In practice, several units 3 in parallel may be provided.

The unit 3 essentially comprises a first compressor, consisting of a main air compressor 7 (or, in an alternative embodiment, several compressors in parallel), a second compressor consisting of an air booster 8 (or, in an alternative embodiment, several boosters in parallel) and a cold box 9. The latter essentially comprises an air distillation apparatus 10, for example a double column comprising a medium-pressure distillation column and a low-pressure distillation column that are coupled via a condenser-reboiler, and a heat exchange line 11.

The compressor 7 and the booster 8 are mounted on a single shaft 12 coupled to a steam turbine 13 via a disconnectable coupling device 14. The turbine 13 has two inlets, namely a high-pressure inlet 15, located at the intake of the turbine, and a medium-pressure inlet 16, located between the high-pressure feed and the exhaust of the turbine. Indicated at 17 is the exhaust port of the turbine, at atmospheric pressure or at a pressure above or below atmospheric pressure.

The apparatus 10 produces low-pressure liquid oxygen LOX and this liquid oxygen is brought to the high production pressure by a pump 18 before being vaporized and warmed in the exchange line 11. The apparatus 10 also produces low-pressure and/or medium-pressure gaseous nitrogen GN, which is warmed in the exchange line and then compressed at 6 to the high production pressure.

In operation, atmospheric air, compressed to the medium pressure at 7, is precooled in an air or water precooler 19, purified of water and of $CO_2$ in an adsorption-type purifier 20 and separated into two streams, namely a first, medium-pressure, air stream, which is cooled at 11 down to close to its dew point before being distilled at 10, and a second air stream that is boosted at 8 to a high pressure allowing the high-pressure liquid oxygen in the exchange line to vaporize.

The unit 3 also includes an auxiliary boiler 21 that produces medium-pressure auxiliary steam in a line 22. This line 22, provided with a valve 23, is connected to the medium-pressure inlet 16 of the turbine 13, whereas the line 2 is connected to the high-pressure inlet 15.

To give an example, the high-pressure steam is at approximately 60 bar and the medium-pressure steam is at approximately 15 bar.

In addition, a branch line 24 fitted with a valve 25 connects the inlets 15 and 16.

During plant startup, the unit 1 produces no high-pressure steam and then it does produce this in increasing amounts until the nominal steady state is reached. The startup operation comprises three successive phases:

1st Phase (FIGS. 1 and 2A): the turbine 13 is supplied only with medium-pressure steam.

However, to balance the upstream expansion part of the turbine, this steam is introduced both into the inlets 15 and 16 via the line 24, the valve 25 of which is open;

2nd Phase (FIGS. 1 and 2B): the valve 25 is closed. The high-pressure steam, with an increasing flow rate, is introduced via the line 2 into the inlet 15 and the necessary additional energy is delivered by a flow of medium-pressure steam, of decreasing flow rate, introduced into the inlet 16; and 3rd Phase (FIGS. 1 and 2C): the valve 25 remains closed; when the steady state is reached, the flow of high-pressure steam at the nominal flow rate is introduced into the inlet 15 and drives the compressors 7 and 8.

Optionally, additional medium-pressure steam may be delivered, continuously or periodically, to the inlet 16, as indicated by the dot-dash line.

FIGS. 3A and 3B relate to the case in which the auxiliary steam is at a pressure above that of the steam produced by the unit 1.

In this case, the first startup phase (FIGS. 1 and 3A) consists in introducing the auxiliary steam into the inlet 15. In the second phase, illustrated by the dot-dash line in FIG. 3A, the medium-pressure steam is introduced, with an increasing flow rate, into the inlet 16 via the line 2, while the flow rate of the make-up steam is correspondingly reduced.

In the third phase (FIGS. 1 and 3B), corresponding to the steady state, the valve 23 is closed. The medium-pressure steam is introduced (nominal flow rate) into the inlet 16. As previously, it may then be advantageous to provide the branch line 24 with its valve 25 so as also to introduce the medium-pressure steam into the inlet 15 and thus balance the expansion part upstream of the turbine.

It may thus be seen that, in both cases, all the steam available in the line 2 is used in the turbine 13 without prior expansion, and therefore without loss of energy. In addition, at any instant, the additional energy for driving the compressors is delivered by the auxiliary steam, the characteristics of which may be chosen relatively freely.

In an alternative embodiment, the compressor 6 may be coupled to the shaft 12, as a replacement of the booster 8 or as a supplement thereof.

Also as an alternative embodiment, if an auxiliary oxygen supply is available on the site, for example a liquid oxygen storage tank, it is possible to start up the unit 1 with this oxygen. During startup of the unit 3, the turbine 13 is then supplied to a minor extent with the steam coming from the unit 1 and to a major extent with the auxiliary steam coming from the supply 21. The ratio is for example 30%/70%. The proportion of auxiliary steam is then progressively lowered until the steady state is reached, in which it becomes the minor proportion, especially less than 30%, and more preferably still less than 10% or even zero.

The turbine may be composed either of a single body with two inputs, which correspond to different intake pressures, or two bodies each having one inlet. In the latter case, one body of the turbine is supplied with steam coming from the industrial unit 1 and the other body with auxiliary steam. The two bodies of the turbine are then either mechanically linked together or mechanically linked to the body of at least one compressor of the air distillation unit.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

A process and apparatus is provided for an integrated air distillation unit and industrial unit wherein at least one compressor of the air distillation unit is driven only by steam expansion means during both start-up and steady state operation.

What is claimed is:

1. A method of driving at least one compressor of an air distillation unit that produces at least one fluid selected from the group consisting of oxygen, nitrogen, and argon, wherein the compressor is driven only by steam expansion means with production of external work, said compressor being joined to said steam expansion means via a disconnectable coupling device, said steam expansion means having two inlets that correspond to different intake pressures, fluid from the air distribution unit is sent to an industrial unit producing steam, wherein during a steady state mode, steam from the industrial unit is sent to an inlet of the steam expansion means, and, during at least the startup of said industrial unit, said steam expansion means are supplied with auxiliary steam coming from an auxiliary steam supply other than said industrial unit and introduced into an inlet of said steam, expansion means.

2. The method as claimed in claim 1, wherein the auxiliary steam comes from an auxiliary steam supply and is introduced into the other inlet and/or the same inlet of these expansion means.

3. The method as claimed in claim 2, wherein, as the industrial unit is progressively brought up to the normal operating conditions, the steam produced by said industrial unit is used to deliver some of the energy for driving the compressor of the air distillation unit via said expansion means.

4. The method as claimed in claim 3, wherein, in the steady state, the expansion means are predominantly supplied with steam coming from said industrial unit.

5. The method as claimed in claim 1, wherein the inlet corresponding to the high intake pressure of said expansion means is supplied practically permanently.

6. The method as claimed in claim 5, wherein the auxiliary steam is at the medium intake pressure and in that the following are supplied in succession:

the two inlets with the auxiliary steam;

the high-pressure inlet with the steam coming from said industrial unit and the medium-pressure inlet with the auxiliary steam; and in the steady state, at least the high-pressure inlet with the steam coming from the industrial unit.

7. The method as claimed in claim 5, wherein the auxiliary steam is at the high pressure and in that the following are supplied in succession:

the high-pressure inlet with the auxiliary steam;

the high-pressure inlet with the auxiliary steam and the medium-pressure inlet with the steam coming from said industrial unit; and in the steady state, the two inlets with the steam coming from said industrial unit.

8. The method as claimed in claim 5, wherein the auxiliary steam is at the high pressure and in that the following are supplied in succession:

the high-pressure inlet with the auxiliary steam; and the high-pressure inlet with the auxiliary steam and the medium-pressure inlet with the steam coming from said industrial unit.

9. The method as claimed in claim 1, wherein at least two compressors of the air distillation unit, which are coupled to a single shaft, are driven in a similar manner.

10. The method as claimed in claim 1, wherein said expansion means comprise a steam turbine having a body provided with two inlets.

11. An apparatus comprising:

(1) at least one air distillation unit which includes at least one compressor driven only by steam expansion means with production of external work, and a cold box containing an air distillation apparatus and a heat exchange line that is designed to cool the compressed air down to a temperature allowing it to be distilled; and (2) at least one industrial unit, which is optionally supplied with at least one industrial gas produced by said air distillation unit, and which produces steam, wherein at least some of this steam feeds said expansion means of said air distillation unit, wherein said expansion means has two inlets that correspond to two different intake pressures, wherein said air distillation unit includes an auxiliary steam supply, wherein this supply delivering steam is at a pressure that corresponds to one of the two inlets of said expansion means and is designed to be connected to this inlet, and herein said industrial unit produces steam at a pressure that corresponds to the other inlet of said expansion means and is designed to be introduced into this other inlet.

12. The apparatus as claimed in claim 11, further comprising means for simultaneously introducing the medium-pressure steam into the two inlets of said expansion means.

13. The apparatus as claimed in claim 11, wherein the compressor is a main air compressor of the air distillation unit.

14. The apparatus as claimed in claim 12, wherein the compressor is a main air compressor of the air distillation unit.

15. The apparatus as claimed in claim 11, further comprising at least a second compressor coupled to the same shaft as the main air compressor.

16. The apparatus as claimed in claim 15, wherein the second compressor is another gas compressor of the air distillation unit.

17. The apparatus as claimed in claim 16, wherein the second compressor is an air booster.

18. The apparatus as claimed in claim 12, wherein said expansion means comprises a steam turbine having a body provided with two inlets.

* * * * *